US006826812B2

(12) United States Patent
Lo

(10) Patent No.: US 6,826,812 B2
(45) Date of Patent: Dec. 7, 2004

(54) FASTENER

(76) Inventor: Wei Wu Lo, 5 F., No. 10, Lane 180, Kwang Fu South Road, Taipei (TW)

( * ) Notice: Subject to any disclaimer, the term of this patent is extended or adjusted under 35 U.S.C. 154(b) by 4 days.

(21) Appl. No.: 10/317,780

(22) Filed: Dec. 11, 2002

(65) Prior Publication Data

US 2003/0106194 A1 Jun. 12, 2003

(30) Foreign Application Priority Data

Dec. 11, 2001 (TW) ..... 90221597 U

(51) Int. Cl.[7] ..... A44B 17/00; A44B 21/00; A41F 1/00

(52) U.S. Cl. ..... 24/662; 24/682.1; 24/701

(58) Field of Search ..... 24/662, 664, 3.12, 24/572.1, 578.1, 581.1, 181, 171, 460, 701, 682.1, 595.1, 596.1; 403/361, 368, 381, 372, 375, 366

(56) References Cited

U.S. PATENT DOCUMENTS 302,421 A * 7/1884 Mosier ..... 24/578.16
796,414 A * 8/1905 Chayes ..... 24/627
4,000,544 A * 1/1977 Fildan ..... 24/588.12
4,578,843 A * 4/1986 Lewis ..... 24/579.09
6,009,604 A * 1/2000 Fildan ..... 24/662

* cited by examiner

*Primary Examiner*—Robert J. Sandy
(74) *Attorney, Agent, or Firm*—Pro-Techtor International Services

(57) ABSTRACT

A fastener installed in a pair of articles for enabling the articles to be detachably fastened together. The fastener includes a male fastening member, the male fastening member having a spacer block, a cylinder integral with the spacer block, a spherical retaining head, and a neck connected between the cylinder and the spherical retaining head, and a female fastening member, the female fastening member having a socket shell adapted for receiving the spherical retaining head and cylinder of the male fastening member, the socket having a retaining rid adapted for engaging the neck of the male fastening member to secure to the male fastening member and the female fastening member together.

3 Claims, 4 Drawing Sheets

FASTENER

BACKGROUND OF THE INVENTION

1. Field of the Invention

The present invention relates to a fastener for fastening two members in a pair and, more particularly, to such a fastener, which is suitable for use in a pair of socks, gloves, or the like to keep the pair of articles detachably fastened together.

2. Description of the Related Art

Various articles, for example, socks, stockings, and gloves are provided in pair for the hands or feet. When several pairs of articles are washed and dried, the user may have to spend a lot of time to pick up a particular pair from the mass of articles.

SUMMARY OF THE INVENTION

The present invention has been accomplished under the circumstances in view. It is the main object of the present invention to provide a fastener, which is provided for installing in a pair of socks, gloves, or the like, for enabling the pair of articles to be detachably fastened together. To achieve this and other objects of the present invention, the fastener comprises a male fastening member and a female fastening member respectively mounted on two members being arranged in pair. The male fastening member comprises a base panel, a spacer block integral with one side of the base panel, a cylinder integral with the top surface of the spacer block in parallel to the base panel, and a spherical retaining head, and a neck connected between the cylinder and the spherical retaining head. The female fastening member comprises a base panel, and a socket shell integral with one side of the base panel. The socket shell comprises a transversely extended receiving hole adapted for receiving the retaining head and cylinder of the male fastening member, a top opening for the passing of the spacer block, and a retaining rib disposed in the rear open side thereof and adapted for engaging the neck of the male fastening member to secure the male fastening member to the female fastening member upon insertion of the retaining head and cylinder of the male fastening member into the receiving hole of the socket shell of the female fastening member.

DETAILED DESCRIPTION OF THE PREFERRED EMBODIMENT

Figure 1:
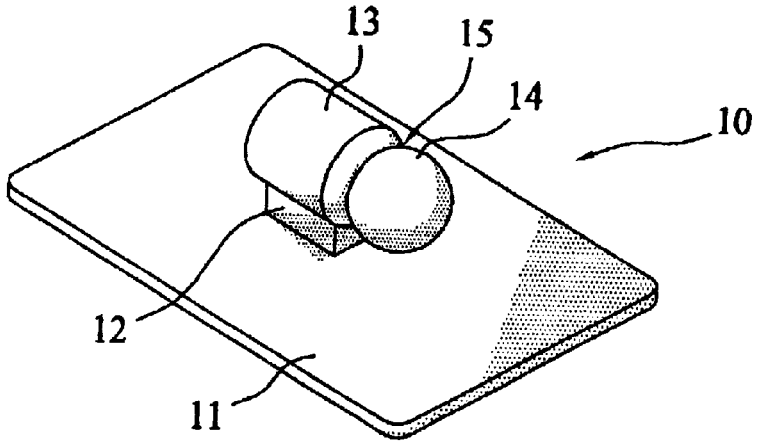
FIG. 1 is a perspective view of a fastener according to the preferred embodiment of the present invention, showing the male fastening member and the female fastening member detached.
Figure 1:
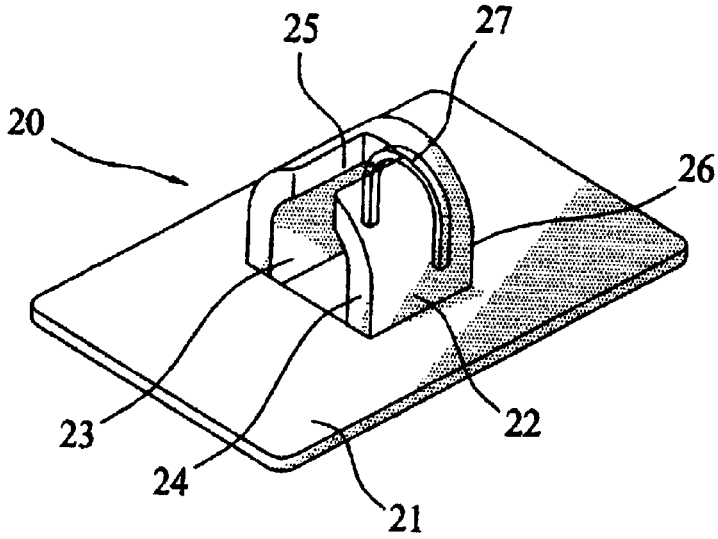
Figure 2:
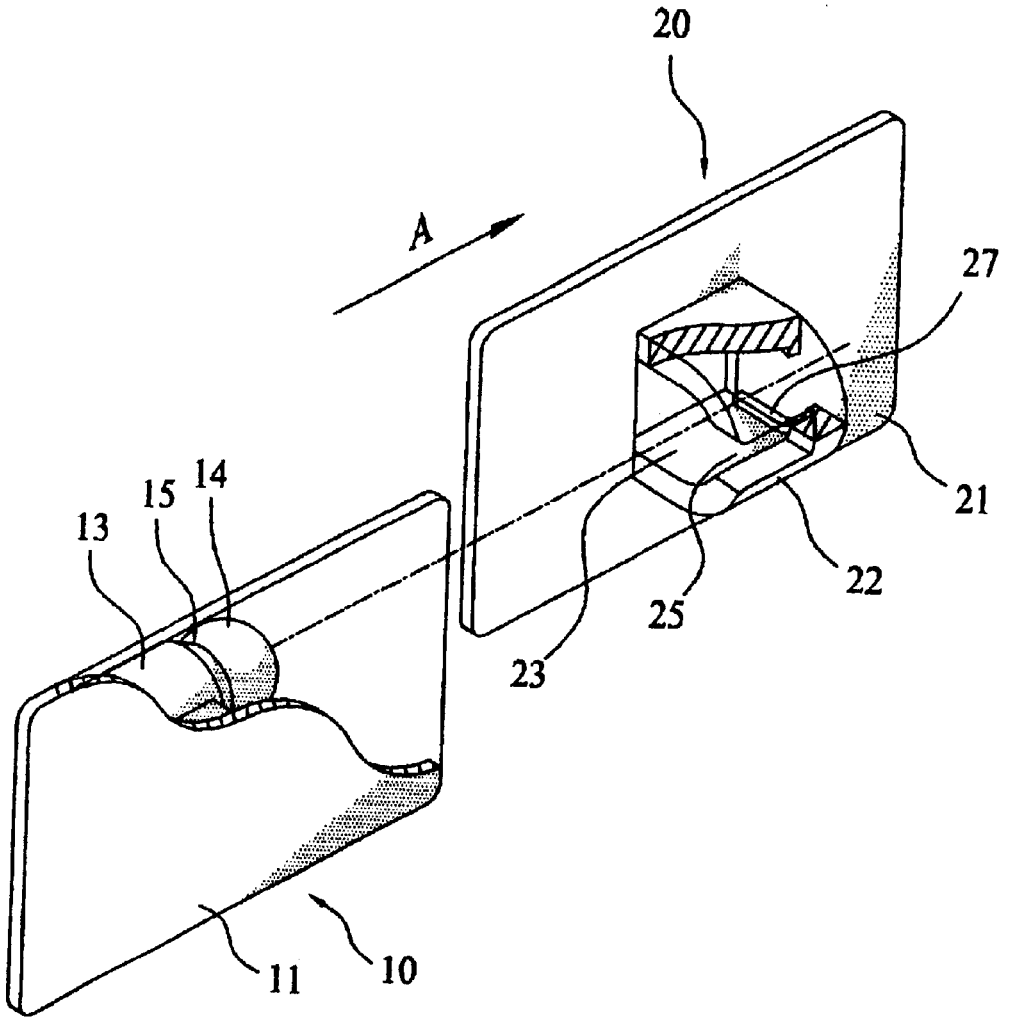
FIG. 2 is schematic drawing showing the spherical retaining head of the male fastening member aimed at the receiving hole of the socket shell of the female fastening member according to the present invention.
Figure 3:
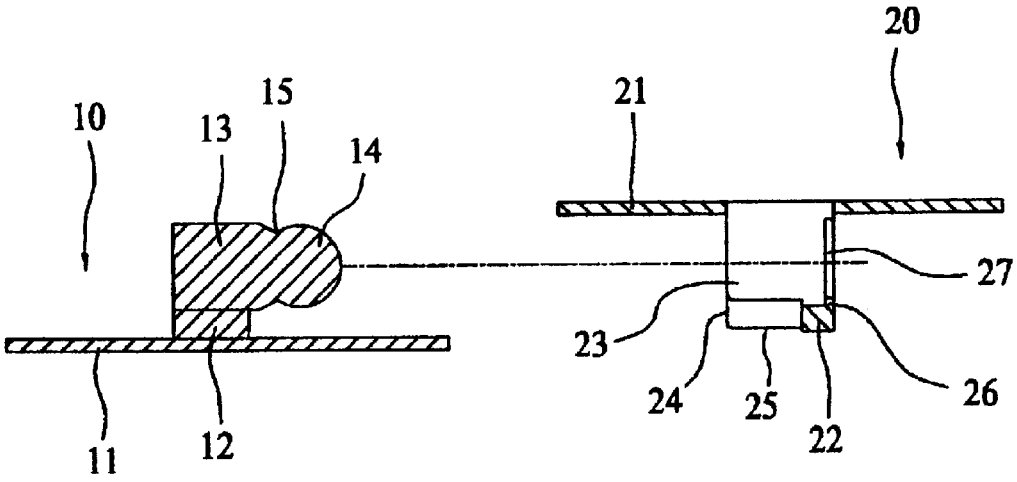
FIG. 3 is a sectional view of FIG. 2.
Figure 4:
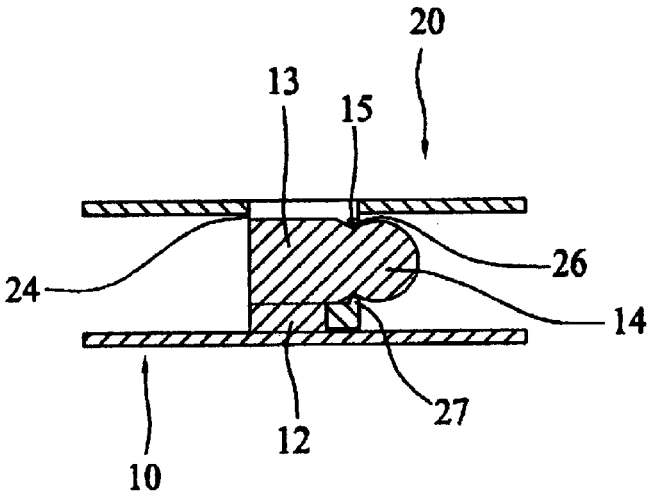
FIG. 4 is a sectional view of the present invention showing the male fastening member fastened to the female fastening member.

Referring to FIG. 1, a fastener in accordance with the present invention is shown comprised of a male fastening member 10 and a female fastening member 20 respectively molded from flexible material, for example, plastics.

The male fastening member 10 comprises a base panel 11, a spacer block 12 integral with the surface of the base panel 11, a cylinder 13 integral with the top surface of the spacer block 12 in parallel to the base panel 11, a spherical retaining head 14, and a neck 15 connected between one end of the cylinder 13 and the periphery of the spherical retaining head 14.

The female fastening member 20 comprises a base panel 21, and a socket shell 22 integral with the top surface of the base panel 21. The socket shell 22 comprises a transversely extended receiving hole 23 adapted for receiving the cylinder 13 of the male fastening member 10, a top opening 25 extended to the front open side 24 thereof corresponding to the width of the spacer block 12, and a retaining rib 27 integral with the rear open side 26 thereof.

Referring to FIGS. from 2 through 4, the spacer block 12 and cylinder 13 of the male fastening member 10 are aimed at the transversely extended receiving hole 23 of the socket shell 22 of the female fastening member 20, and then the male fastening member 10 is moved toward the female fastening member 20 in the arrowhead direction A to force the cylinder 13 and the spherical retaining head 14 into the receiving hole 23 of the socket shell 22. At this time, the spacer block 12 is engaged into the top opening 25, and the spherical retaining head 14 is forced out of the rear open side 26 of the socket shell 22, keeping the neck 15 in engagement with the retaining rib 27 of the socket shell 22, and therefore the male fastening member 10 and the female fastening member 20 are fastened together. On the contrary, when unfastening the fastening members 10 and 20, pull the male fastening member 10 from the female fastening member 20 in direction reversed to the arrowhead direction A.

As indicated above, when fastened up the male fastening member 10 and the female fastening member 20, the retaining rib 27 of the female fastening member 20 and the neck 15 of the male fastening member 10 are engaged with each other, keeping the male fastening member 10 and the female fastening member 20 positively secured together.

Figure 5:
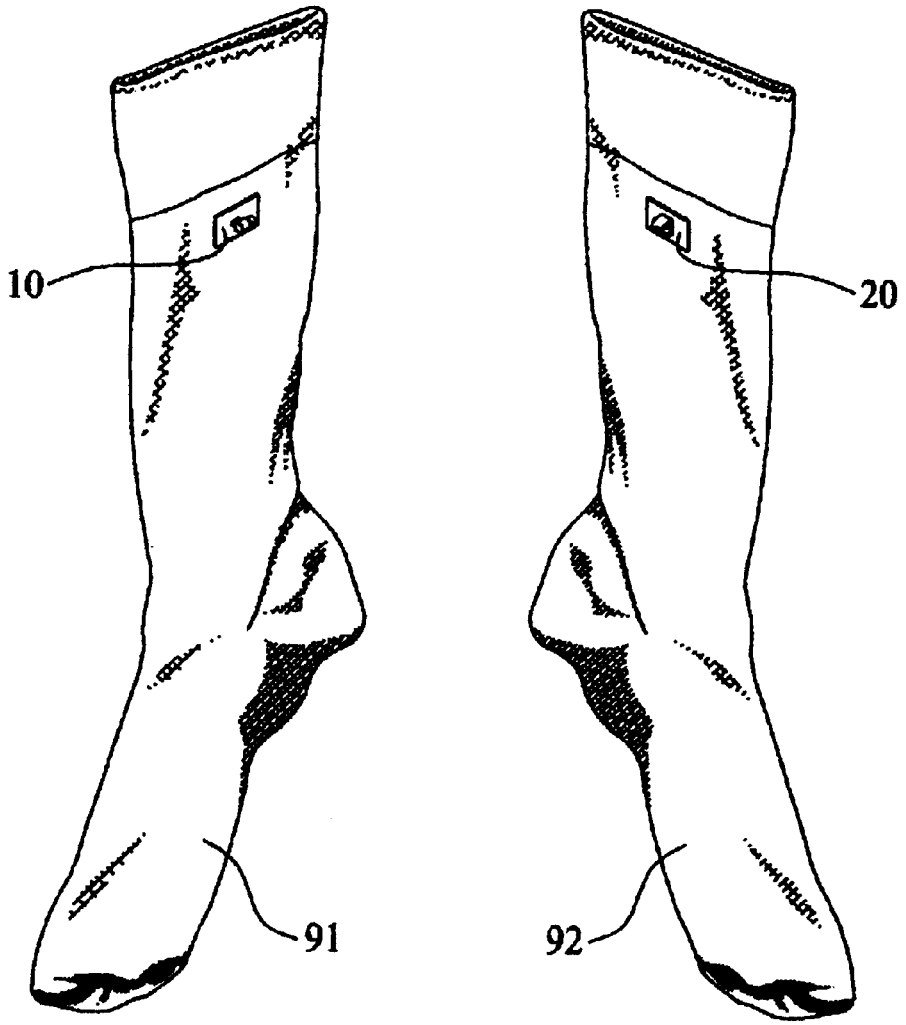
FIG. 5 shows an application example of the present invention.

Referring to FIG. 5, the male fastening member 10 and the female fastening member 20 are respectively mounted on a respective piece of sock 91 or 92, for enabling the sockets 91 and 92 to be detachably fastened together.

A prototype of fastener has been constructed with the features of FIGS. 1~5. The fastener functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A fastener comprising:

a male fastening member, said male fastening member comprising a base panel, a spacer block integral with one side of the base panel of said male fastening member, a cylinder integral with a top surface of said spacer block in parallel to the base panel of said male fastening member, and a retaining head extended from one end of said cylinder; and a female fastening member, said female fastening member comprising a base panel, and a socket shell integral with one side of the base panel of said female fastening member, said socket shell comprising a transversely extended receiving hole adapted for receiving the retaining head and cylinder of said male fastening member to hold said male fastening member and said female fastening member together; wherein said male fastening member further comprises a neck connected between said cylinder and said retaining head, and said socket shell comprises a retaining rib disposed in a rear open side thereof and adapted to engage the neck of said male fastening member upon insertion of the retaining head and cylinder of said male fastening member into the receiving hole of said socket shell of said female fastening member.

2. The fastener as claimed in claim 1, wherein:

said socket shell of said female fastening member comprises a top opening extended to a front open side thereof in communication with said receiving hole and adapted for receiving the spacer block of said male fastening member during insertion of the retaining head and cylinder of said male fastening member into the receiving hole of said female fastening member.

3. The fastener as claimed in claim 1, wherein:

the retaining head of said male fastening member is a spherical head.

* * * * *